United States Patent [19]

Princehouse

[11] 3,940,969

[45] Mar. 2, 1976

[54] APPARATUS AND METHOD FOR FORGING A BICYCLE CRANK

[75] Inventor: Joseph B. Princehouse, Dayton, Ohio

[73] Assignee: The Harris-Thomas Drop Forge Company, Dayton, Ohio

[22] Filed: Oct. 18, 1974

[21] Appl. No.: 515,995

[52] U.S. Cl. ..... 72/354; 72/356; 72/377; 29/6

[51] Int. Cl.[2] ..... B21K 1/08

[58] Field of Search ..... 72/302, 306, 354, 356, 72/377; 29/6; 74/594.1, 594.2

[56] References Cited

UNITED STATES PATENTS

| | | | |
|---|---|---|---|
| 710,245 | 9/1902 | Brooks | 74/594.2 |
| 1,575,427 | 3/1926 | Henry | 29/6 |
| 2,759,379 | 8/1956 | Brandt | 72/354 |
| 3,864,956 | 2/1975 | Barry | 72/354 |

*Primary Examiner*—Lowell A. Larson
*Attorney, Agent, or Firm*—Jacox & Meckstroth

[57] ABSTRACT

An elongated rod is heated and then inserted into a series of axially spaced die sets each consisting of a pair of mating gripping dies defining a plurality of axially spaced cavities. The rod is gripped by the die sets at axially spaced intervals, and the die sets are then forced axially together by actuation of a press to expand portions of the rod into the cavities and thereby form a plurality of axially spaced enlarged bosses on the rod. The rod is bent to form a set of crank arms integrally connected by an axle portion which has two of the axially spaced bosses. Cylindrical surfaces are forged on the two bosses, and one of the bosses is forged into an outwardly projecting sprocket retaining stud.

6 Claims, 9 Drawing Figures

APPARATUS AND METHOD FOR FORGING A BICYCLE CRANK

BACKGROUND OF THE INVENTION

In the production of a forged bicycle crank of the general type disclosed in U.S. Pat. No. 624,635, commonly an elongated steel rod is heated in a furnace and then manually and progressively transferred to a series of cavities formed with a forging die set. The die cavities provide for bending the rod to form a set of crank arms integrally connected by an axle portion. The axle portion is forged to form a cylindrical seat for a chain drive sprocket and to form a pair of enlarged cylindrical collars or bosses which are subsequently machined to retain the inner races of a set of anti-friction crank support bearings. The rod from which the crank is forged commonly has an original diameter slightly smaller than the diameter of the enlarged bosses but greater than the diameter of the rod portion between the bosses and the rod end portions which form the crank arms. As a result of the reduction in diameter of the rod to form the crank arms and the axle, the forged crank has a final overall length greater than that of the original steel rod.

It is also common in the forging of a bicycle crank to form a projecting sprocket engaging pin or stud on one of the crank arms as shown in the above patent to prevent rotation of the sprocket relative to the crank. U.S. Pat. No. 3,608,184 discloses another method for making a bicycle crank. In this patent, threads are rolled on the enlarged collars or bosses prior to bending the rod to form the crank arms, and a sprocket engaging pin or stud is then welded to one of the crank arms. However, this method presents a problem of possibly damaging the rolled threads during the bending and/or welding operation.

It has also been proposed to cold forge a bicycle crank by first reducing the diameter of one end portion of a metal rod and then forming one of the cylindrical bearing surfaces and the sprocket seat by a compression upset forming operation. The rod is then turned end-for-end, and the opposite end portion of the rod is reduced in diameter by a forging operation after which the second cylindrical bearing surface is formed by a compression upset forging operation. The rod is then bent to form the pedal crank arms, and a sprocket engaging stud is welded to one of the crank arms.

SUMMARY OF THE INVENTION

The present invention is directed to an improved method and apparatus for forging a one-piece bicycle crank having an integral sprocket engaging stud, and which provides for significantly reducing the time and labor for producing each crank. The method is also desirable in that it significantly reduces the number of forging steps or operations to produce a crank and thereby significantly increases the efficiency of producing cranks in substantial volume.

In accordance with one embodiment of the invention, an elongated metal rod is heated to a red hot condition and is then inserted axially into a set of axially spaced forging die sets which define a plurality of enlarged cavities. The die sets are closed for rigidly gripping the metal rod at axially spaced intervals, and then the die sets are forced axially together causing the rod to expand outwardly into the cavities and thereby form a corresponding plurality of axially spaced enlarged bosses on the rod.

Immediately after the rod with the enlarged bosses is released from the die sets, the rod is bent to form a set of crank arms integrally connected by an axle portion. The axle portion is provided with two of the axially spaced enlarged bosses, and one of the crank arms includes an enlarged boss. The enlarged bosses on the axle portion are forged into the sprocket and bearing seats, and the enlarged boss on the crank arm is forged into the integral sprocket engaging stud. In addition, enlarged end portions are simultaneously formed on the crank arms. After a thin flash is trimmed from the forged crank, the bearing and sprocket seats are machined to form precise cylindrical surfaces, and the enlarged end portions of the crank arms are machined to form threaded holes or eyes for receiving the pedal axles.

Other features and advantages of the invention will be apparent from the following description, the accompanying drawings and the appended claims.

DESCRIPTION OF THE PREFERRED EMBODIMENT

Referring to FIGS. 1 – 5 which illustrate the successive forging steps or operations for producing a bicycle crank in accordance with the invention, an elongated cylindrical steel rod 15 is heated to a red hot condition, preferably in an induction furnace, and is inserted or fed axially into a series of axially spaced die sets which will be described later. The die sets grip the rod 15 at longitudinally spaced intervals and are forced or pressed together so that a set of generally cylindrical enlarged bosses 18, 19 and 22 are formed on the rod in axially spaced relation.

Figure 3:
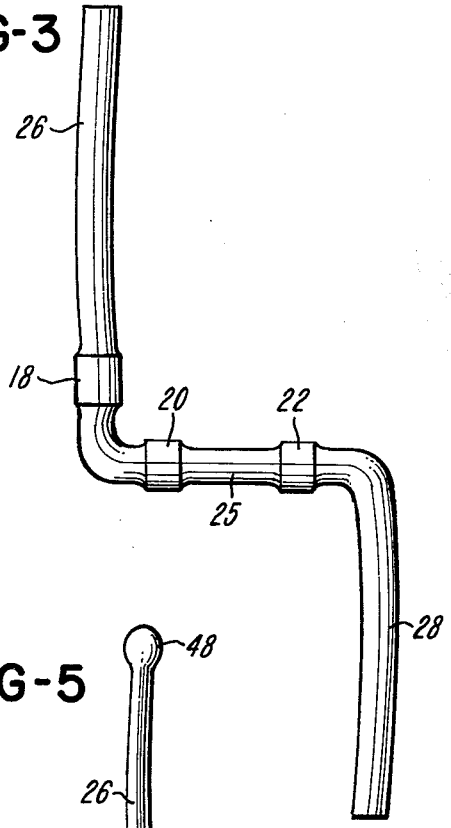
Figure 4:
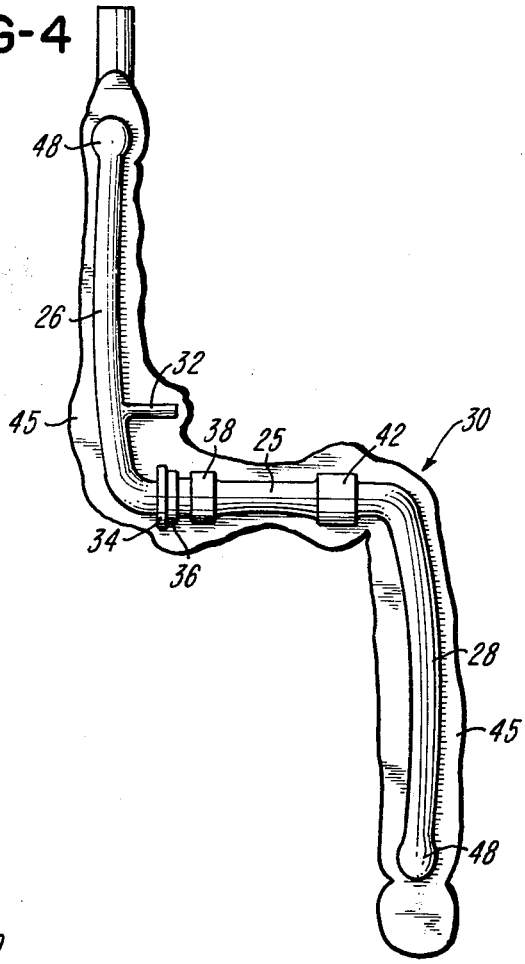

Immediately after the enlarged bosses are formed, the rod is inserted between a set of forging dies (not shown) which bend the rod to form an axle portion 25 (FIG. 3) and a set of integrally connected crank arms 26 and 28. The enlarged boss 18 forms a part of the crank arm 26, and the enlarged bosses 20 and 22 form part of the axle portion 25. The bent rod, with the enlarged bosses 18, 20 and 22, is then transferred and placed between a set of forging dies and is forged into the configuration of a bicycle crank 30 as shown in FIG. 4. In this forging operation, the enlarged boss 18 is formed into an outwardly projecting sprocket retaining stud 32, and the enlarged boss 20 is formed into a circular flange 34, a cylindrical sprocket support seat 36 and a cylindrical bearing support seat or surface 38. The forging operation also forms the enlarged boss 22 into a second substantially cylindrical bearing support seat or surface 42.

As illustrated in FIG. 4, the forging operation produces a thin metal flash 45 which results from the excess metal flowing outwardly between the dies of the forging die set. The forging dies also produce slightly enlarged end portions 48 on the crank arms 26. These end portions 48 are subsequently drilled and tapped to form threaded holes or "eyes" for receiving the threaded axles of the bicycle pedals (not shown). The metal flash 45 shown in FIG. 4 is removed or sheared from the forged crank 30 by a trimming die set (not shown) so that the resulting forged crank 30 has the configuration shown in FIG. 5 before it receives the conventional machining and plating operations.

Referring to FIGS. 6 – 9 which show the forging machine for forming the axially spaced enlarged bosses 18, 20 and 22 on the rod 15, a series of die sets 56, 58, 62 and 64 are arranged in axially spaced relation. The die set 56 includes a set of mating forging dies 57, and the die sets 58, 62 and 64 each consists of corresponding mating dies 59, 63 and 66, respectively. Each pair of mating dies are formed with opposing semi-cylindrical surfaces 68 having a diameter substantially the same as the diameter of the rod 15. In addition, the dies 59, 63 and 66 have enlarged substantially cylindrical cavities 72, 74 and 76, respectively. The leading ends of the dies 57 are provided with corresponding tapered surfaces 78 which provide a lead surface for guiding the rod 15 axially into the forging machine and between the die sets when the die sets are in their open positions shown in FIG. 6.

Preferably, elongated steel rods 15 are successively fed into the die sets after the rods are heated to a red hot condition within an induction furnace (not shown). Each rod is moved axially from the furnace and into the die sets by a carriage member which depends from a set of tracks (not shown) extending from the furnace into the forging machine above the die sets. As each rod 15 is moved axially into the die sets, the leading end of the rod engages an L-shaped stop plate or member 82 (FIG. 9) which is secured to one of the dies 66 of the die set 64 and is adapted to project into a slot 83 formed within the other die 66.

Figure 6:
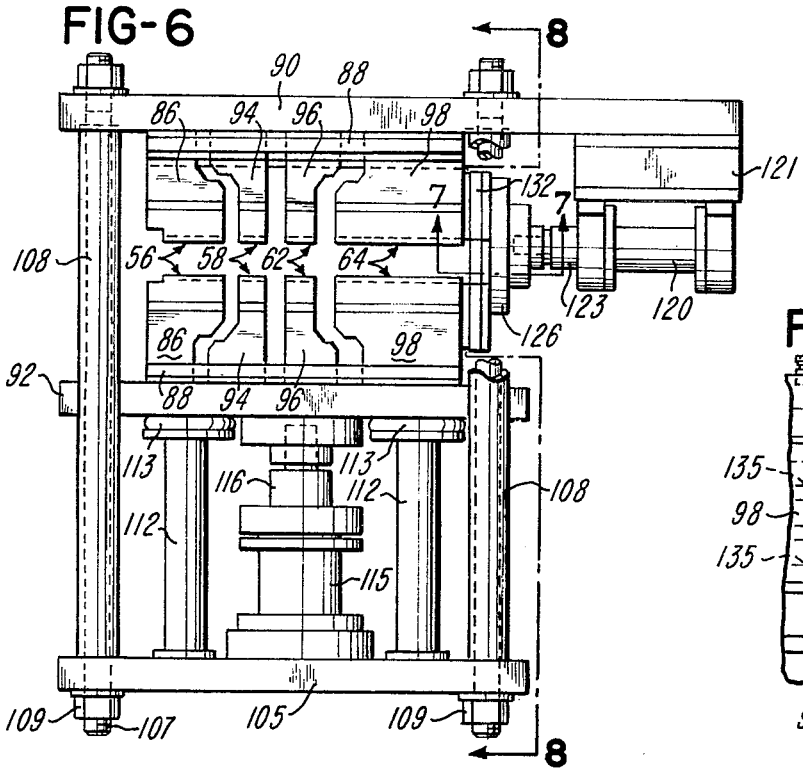
FIG. 6 is a plan view of a forging machine constructed in accordance with the invention and which performs the forging operation illustrated in FIG. 2.

As shown in FIG. 6, the dies 57 of the die set 56 are supported by a corresponding set of brackets 86 which are rigidly secured and keyed to corresponding ends of a pair of guide rails 88 arranged in parallel spaced relation. One of the guide rails 88 is rigidly secured to a stationary platen 90, and the other guide rail 88 is secured to a movable platen 92 positioned parallel to the platen 90. The die sets 58, 62 and 64 are supported by corresponding pairs of support brackets 94, 96 and 98, respectively, which are supported for relative sliding movement by the set of guide rails 88.

Figure 8:
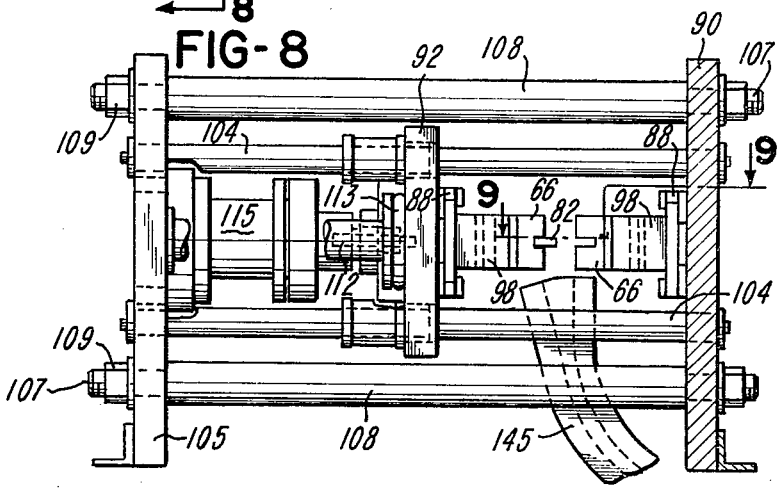
FIG. 8 is an elevational view, in part section, and taken generally on the line 8—8 of FIG. 6.
Figure 9:
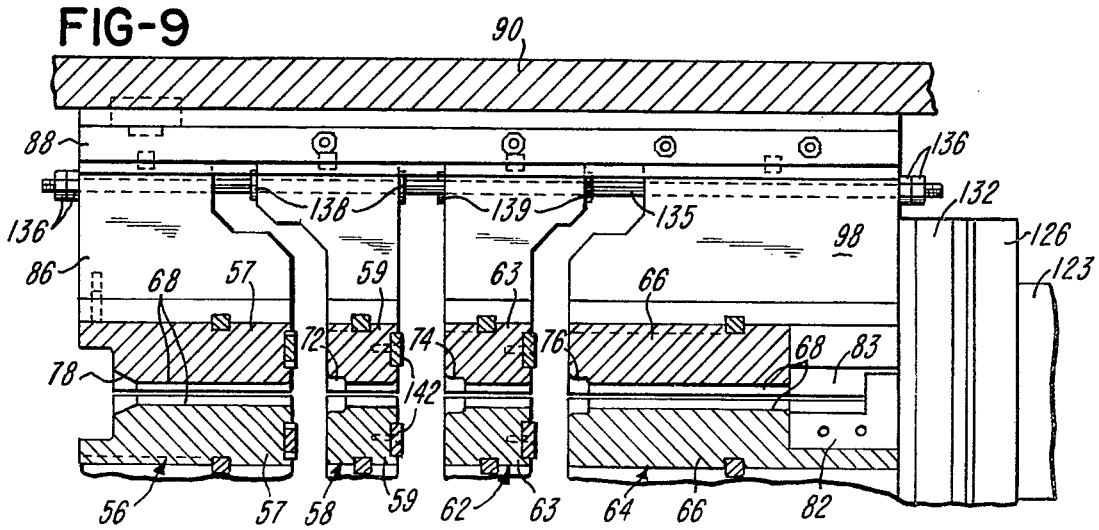
FIG. 9 is an enlarged fragmentary plan view of the die sets forming part of the machine shown in FIG. 6 and as taken generally on the line 9—9 of FIG. 8.

Referring to FIGS. 6 and 8, the movable platen 92 is supported by a set of four guide rods 104 which extend in parallel spaced relation from the stationary platen 50 to another parallel spaced stationary platen 105. The stationary platens 90 and 105 are also rigidly connected by a set of four tie rods 107 (FIG. 6) which extend through corresponding elongated spacer tubes 108 and receive corresponding nuts 109 to form a rigid connected between the platens 90 and 105. When the movable platen 92 is in its retracted position (FIGS. 6 and 8), the platen 92 engages a pair of laterally spaced horizontal stop members 112 which project from the stationary platen 105 and support resilient cushion members 113.

The die sets 56, 58, 62 and 64 are moved between their open positions (FIG. 6) and their closed positions (FIG. 9) by actuation of a hydraulic cylinder 115 positioned between the stop members 112. The cylinder is rigidly secured to the stationary platen 105 and includes a piston 116 connected to the movable platen 92. After a heated rod 15 is fed or inserted axially between the forging die sets, the cylinder 15 is actuated so that the dies supported by the platen 92 move towards the corresponding mating dies supported by the platen 90, and the rod is firmly gripped at longitudinally spaced intervals by the die sets.

Figure 7:
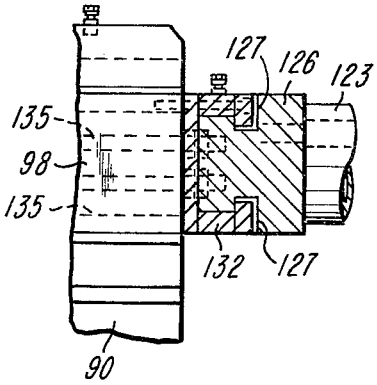
FIG. 7 is a fragmentary section taken generally on the line 7—7 of FIG. 6.

As shown in FIGS. 6 and 7, another hydraulic cylinder 120 is rigidly supported by a block or spacer member 121 which is secured to a projecting end portion of the stationary platen 90. The cylinder 120 includes a piston rod 123 which is rigidly secured to a slide block 126 (FIG. 7) having a pair of elongated grooves 127 extending parallel to the slide rods 104. A C-shaped slide member 123 is secured to each of the brackets 98 which support the die set 64, and are slidably received within the grooves 127 to permit movement of the die sets between their open position (FIG. 6) and the closed positions (FIG. 9) while the die sets remain connected to the piston 123 of the hydraulic cylinder 120.

A pair of vertically spaced parallel connecting rods 135 (FIGS. 8 and 9) extend through the support brackets 86, 94, 96 and 98 adjacent the corresponding guide rails 88, and a set of lock nuts 136 are secured to the opposite end portions of each rod 135. The rods 135 are free to slide within each of the support brackets with the exception that each of the support brackets 94 is secured to the corresponding upper rod 135 by a set of retaining rings 138, and each of the support brackets 96 is secured to the lower corresponding rod 135 by another set of retaining rings 139. The retaining rings 138 and 139 are positioned on opposite sides or ends of the corresponding support brackets 94 and 96, respectively, so that axial movement of the die sets 58 produces axial movement of the upper rod 135, and axial movement of the die set 62 produces corresponding movement of the lower rod 135.

In operation of the forging machine shown in FIGS. 6 – 9, after a heated rod is inserted into the machine between the die sets 56, 58, 62 and 64, the cylinder 115 is actuated so that the die sets grip the rod 15 at axially spaced intervals, as mentioned above. After the rod is rigidly gripped, the hydraulic cylinder 120 is actuated to extend the corresponding rod 123, causing the die sets to be moved axially together until the adjacent die sets contact the corresponding wear plates 142 which are recessed within the dies of each of the dies 57, 59 and 63. As the closed die sets are moved axially together, portions of the rod 15 are compressed axially so that the metal moves outwardly into the cavity 72, 74 and 76, thereby forming the corresponding enlarged bosses 18, 20 and 22 on the rod 15.

Figure 1:
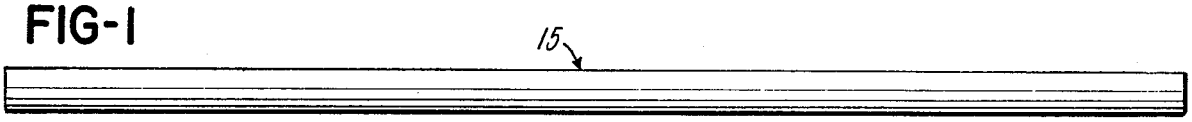
FIGS. 1 – 5 illustrate a series of forging operations performed in accordance with the invention for producing a bicycle crank.
Figure 2:
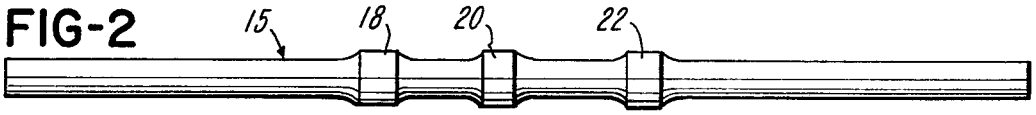

As illustrated in FIG. 2, the axial compression of the rod 15 to form the enlarged bosses, results in shortening the overall length of the rod, for example, by approximately 2¾ inches. As soon as the die set 58 contacts the die set 56, and the die set 62 contacts the die set 58, and the die set 64 contacts the die set 62 forming the enlarged bosses 18, 20 and 22, the hydraulic cylinder 115 is actuated to retract the platen 92 and the corresponding dies which are supported by the guide rail 88 mounted on the platen 92. The axially compressed rod 15 is thereby released, after which the hydraulic cylinder 120 is actuated to retract the piston rod 123.

Figure 5:
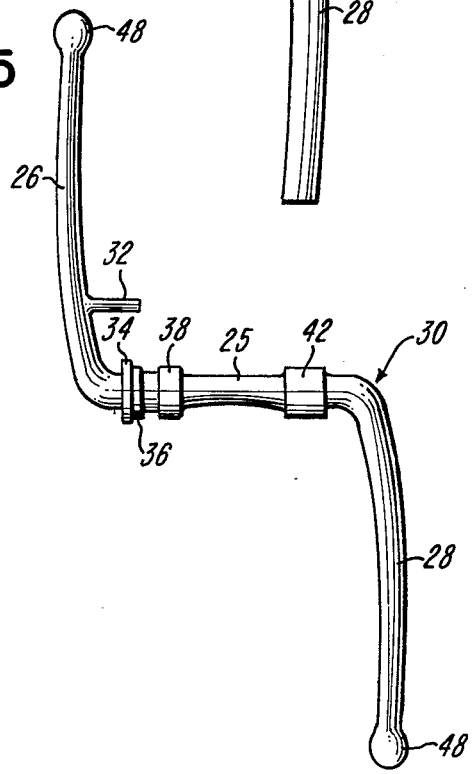

The retraction or outward movement of the support brackets 98 and the corresponding die set 64, is effective to return the die sets 58 and 62 to their original or normal axially spaced positions (FIG. 6) as a result of the movement of the tie rods 135 within the corresponding support brackets 98. That is, the upper rod 135 retracts the die set 58 to its original position shown in FIG. 6, and the lower rod 135 retracts the die set 62 to its original position shown in FIG. 6. When the die sets are moved to their open positions (FIG. 6) in response to actuation of the cylinder 115, the forged rod 15, including the axially spaced enlarged bosses 18, 20 and 22, drops from the die sets and rolls onto a guide chute or ramp 145 which directs the forged rod into the path of a carriage (not shown) which quickly transfers the rod shown in FIG. 2 into the forging die set where the forging operations shown in FIGS. 3 – 5 are performed.

From the drawings in the above description, it is apparent that the method and apparatus for a bicycle crank in accordance with present invention, provide desirable features and advantages. As mentioned above, the forging operation performed with the apparatus shown in FIGS. 6 – 9 to form the enlarged bosses, and the forging of one of the bosses into the stud 32, significantly reduces the number of forging steps required to produce a bicycle crank and thereby significantly reduces the time and labor involved in the manufacturing of bicycle cranks in high volume. In addition, the forging machine is adapted to be automatically operated so that the enlarged bosses are formed on the metal rod without requiring any manual handling of the rod. Furthermore, the method and apparatus of the invention provide for using rod stock of smaller diameter diameter and also result in reducing the scrap metal produced in the forging of each crank.

While the method and form of forging apparatus herein described constitute a preferred embodiment of the invention, it is to be understood that the invention is not limited to the precise method and form of apparatus described, and that changes may be made therein without departing from the scope and spirit of the invention as defined in the appended claims.

The invention having thus been described, the following is claimed:

1. An improved method for producing a forged bicycle crank including generally parallel crank arms projecting in opposite directions from an integrally connecting center axle portion, comprising the steps of heating an elongated metal rod, inserting the metal rod into a set of axially spaced dies defining a plurality of enlarged cavities disposed axially inwardly from opposite elongated end portions of the rod, gripping the rod with said dies, moving said dies axially together to forge a corresponding plurality of intermediate portions of the rod outwardly into said cavities and to form a plurality of outwardly projecting and axially spaced enlarged intermediate bosses on the rod between the opposite elongated end portions of the rod, bending the rod adjacent two of said enlarged intermediate bosses to form a first crank arm from one of said end portions of the rod and a second crank arm from the other said end portion of the rod and with said crank arms integrally connected by a center axle portion having two of said enlarged intermediate bosses, and forming bearing support surfaces on said enlarged intermediate bosses of said center axle portion.

2. An improved method for producing a forged bicycle crank including generally parallel crank arms projecting in opposite directions from an integrally connecting center axle portion, comprising the steps of heating an elongated metal rod, inserting the metal rod into a set of axially spaced dies defining a plurality of enlarged cavities disposed axially inwardly from opposite elongated end portions of the rod, gripping the rod with said dies, moving said dies axially together to forge a corresponding plurality of intermediate portions of the rod outwardly into said cavities and to form a plurality of outwardly projecting and axially spaced enlarged intermediate bosses on the rod between the opposite elongated end portions of the rod, bending the rod adjacent two of said enlarged intermediate bosses to form a first crank arm from one of said end portions of the rod and a second crank arm from the other said end portion of the rod and with said crank arms integrally connected by a center axle portion, the bending providing said first crank arm with one of said enlarged intermediate bosses and said axle portion with two of said enlarged intermediate bosses, forging said one enlarged intermediate boss on said first crank arm into an outwardly projecting sprocket retaining stud, and forming bearing support surfaces on said enlarged bosses of said center axle portion.

3. An improved method for producing a forged bicycle crank including generally parallel crank arms projecting in opposite directions from an integrally connecting center axle portion, comprising the steps of heating an elongated metal rod, inserting the metal rod into a set of axially spaced dies defining three axially spaced enlarged cavities disposed axially inwardly from opposite elongated end portions of the rod, gripping the rod with said dies, moving said dies axially together to forge three axially spaced intermediate portions of the rod outwardly into said cavities and to form three outwardly projecting and axially spaced enlarged intermediate bosses on the rod between the opposite elongated end portions of the rod, bending the end portions of the rod adjacent two of said enlarged intermediate bosses to form a first crank arm from one of said end portions of the rod and a second crank arm from the other said end portion of the rod and with said crank arms integrally connected by a center axle portion, the bending providing said first crank arm with one of said enlarged intermediate bosses and said axle portion with two of said enlarged intermediate bosses, forging said one enlarged intermediate boss on said first crank arm into an outwardly projecting sprocket retaining stud, and forming bearing support surfaces on said enlarged bosses of said center axle portion.

4. Apparatus adapted for use in forging a bicycle crank, comprising a rigid frame including first and second stationary platens disposed in parallel spaced relation, means rigidly connecting said stationary platens, a plurality of parallel spaced guide rods extending between said stationary platens, a movable platen mounted on said guide rods for movement between said stationary platens, a series of die sets each including a pair of opposing mating dies, said die sets being spaced along an axis and defining a plurality of axially spaced enlarged cavities, said die sets adapted to receive an elongated metal rod extending on said axis, first track means mounted on said first stationary platen and supporting corresponding said dies of said die sets for relative axial movement, second track means mounted on said movable platen and supporting the opposing corresponding said dies of said die sets for relative axial movement, a first fluid cylinder disposed between said movable platen and said second stationary platen and connected to move said movable platen and the corresponding said dies for gripping and releasing the rod with said die sets, a second fluid cylinder mounted on said frame and including a piston, third track means connecting said piston to the adjacent said die set and providing for relative movement of the corresponding said dies, and said second fluid cylinder being effective to move said die sets axially together after the rod is gripped for reducing the length of the rod and to form within said cavities a plurality of axially spaced enlarged bosses on the rod intermediate its end portions.

5. Apparatus as defined in claim 4 including a plurality of parallel spaced elongated tie rods supported for axial movement, and means for connecting adjacent said die sets to different said tie rods.

6. Apparatus adapted for forging a bicycle crank, comprising a rigid frame including first and second horizontally spaced substantially vertical stationary platens, means rigidly connecting said stationary platens, a plurality of generally horizontal parallel spaced guide rods extending between said stationary platens, a substantially vertical movable platen mounted on said guide rods for generally horizontal movement between said stationary platens, a series of die sets each including a pair of horizontally spaced opposing mating dies, said die sets being spaced along a horizontal axis and defining a plurality of axially spaced enlarged cavities, said die sets adapted to receive an elongated metal rod extending on said axis, generally horizontally extending first track means mounted on said first stationary platen and supporting corresponding said dies of said die sets for generally horizontal relative movement, generally horizontal second track means mounted on said movable platen and supporting the opposing corresponding said dies of said die sets for horizontal relative movement, a first fluid cylinder disposed between said movable platen and said second stationary platen and connected to move said movable platen and the corresponding said dies for gripping and releasing of the rod within said die sets, a second fluid cylinder mounted on said frame and including a generally horizontally movable piston, generally horizontally third track means connecting said piston to the adjacent said die set, and said second fluid cylinder being effective to move said die sets axially together after the rod is gripped for reducing the length of the rod and to form within said cavities a plurality of axially spaced enlarged bosses on the rod intermediate its end portions.

* * * * *